US009820051B2

(12) United States Patent
Mao et al.

(10) Patent No.: US 9,820,051 B2
(45) Date of Patent: Nov. 14, 2017

(54) ELECTROMAGNETIC SPEAKER

(71) Applicants: Lubin Mao, Shenzhen (CN); Hongxing Wang, Shenzhen (CN); Shun Guo, Shenzhen (CN); Fei Hou, Shenzhen (CN)

(72) Inventors: Lubin Mao, Shenzhen (CN); Hongxing Wang, Shenzhen (CN); Shun Guo, Shenzhen (CN); Fei Hou, Shenzhen (CN)

(73) Assignee: AAC ACOUSTIC TECHNOLOGIES (SHENZHEN) CO., LTD., Shenzhen (CN)

( * ) Notice: Subject to any disclaimer, the term of this patent is extended or adjusted under 35 U.S.C. 154(b) by 0 days.

(21) Appl. No.: 14/827,627

(22) Filed: Aug. 17, 2015

(65) Prior Publication Data

US 2016/0227326 A1 Aug. 4, 2016

(30) Foreign Application Priority Data

Feb. 2, 2015 (CN) ..... 2015 2 0074069 U

(51) Int. Cl.
*H04R 9/02* (2006.01)
*H04R 9/06* (2006.01)

(52) U.S. Cl.
CPC ..... *H04R 9/025* (2013.01); *H04R 9/066* (2013.01)

(58) Field of Classification Search
CPC .... H04R 9/025; H04R 2400/03; H04R 9/066; H04R 2400/07; H02K 33/16; H02K 33/12; H02K 33/18; B06B 1/045; H01F 2007/1692; H01F 7/066; H01F 7/122; H01F 7/06
USPC ..... 381/15, 25, 81, 412, 417, 418, 420; 310/150, 162, 338, 396, 412, 413, 417; 340/407.1; 335/222, 227, 229, 220
See application file for complete search history.

(56) References Cited

U.S. PATENT DOCUMENTS 3,649,776 A * 3/1972 Burton ..... H04R 1/345 381/342
4,327,257 A * 4/1982 Schwartz ..... H04R 9/022 181/171
5,708,726 A * 1/1998 Brinkley ..... G08B 6/00 340/7.58
5,896,076 A * 4/1999 van Namen ..... H01F 7/1615 335/222
6,211,775 B1 * 4/2001 Lee ..... G08B 6/00 340/407.1
2001/0017922 A1 * 8/2001 Kim ..... H04R 9/025 381/150

* cited by examiner

*Primary Examiner* — Davetta W Goins
*Assistant Examiner* — Phylesha Dabney
(74) *Attorney, Agent, or Firm* — Na Xu; IPro, PLLC

(57) ABSTRACT

An electromagnetic speaker is disclosed and includes a frame having an elongated axis, a magnet magnetized along a radial direction and received in the frame, a voice coil fixed relatively to the frame and surrounding the magnet, a first elastic plate suspending the magnet in the frame, and a vibrating plate driven by the magnet to move along the elongated axis of the frame. By virtue of the configuration mentioned above, the electromagnetic speaker has a small form with a reduced height. Further, greater driving force is generated by the magnet driving the vibrating plate.

17 Claims, 5 Drawing Sheets

ELECTROMAGNETIC SPEAKER

FIELD OF THE INVENTION

The present invention relates to transducers for converting electrical signals to audible sounds, and more particularly to an electromagnetic speaker for producing vibrations by virtue of electromagnetic force.

DESCRIPTION OF RELATED ART

Sound which can be heard by a person's auditory sense is transmitted in the form of waves. The sound having the wave form moves air molecules and vibrates the tympanic membrane, thus allowing a person to hear the sound. In order to provide audible sounds, various kinds of sound generators have been developed. A sound generator is generally coupled to an audio equipment or an amplifier for use as a large sound producing means for considerably amplifying volume. Alternatively, the sound generator may be used as a small sound producing means having a small size and volume.

An electronic device, such as a cellular phone, a camcorder, a PDA, a digital camera, or a notebook computer, provides a space for accommodating a sound generator therein. Nowadays, a sound generator with high quality audio performance and miniature size is desired.

Generally, a speaker includes a frame, a magnetic circuit positioned by the frame, and a vibration unit interacting with the magnetic circuit for producing vibrations. The magnetic circuit includes a yoke, a magnet positioned on the yoke, and a magnetic gap formed between the yoke and the magnet. The vibration unit generally includes a voice coil having an end thereof in the magnetic gap, and a diaphragm connected with the voice coil.

While electrified, the voice coil interacts with the magnetic circuit and Lorenz Force is accordingly produced. By the Lorenz Force, the voice coil is actuated to vibrate and further drives the diaphragm to vibrate. Sound waves are thus generated.

The mobile phone will be designed to have bigger and bigger screen and at the same time to have thinner and thinner height. The speaker generally includes a vibration unit vibrating along a direction perpendicular to the screen. Obviously, the vibration amplitude will be restricted by the thinner height, which will badly affect the acoustic performance.

Accordingly, an improved electromagnetic speaker enabling solving the problems mentioned above and having a greater vibration amplitude is desired.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENTS

The present invention will hereinafter be described in detail with reference to exemplary embodiments.

Figure 1:
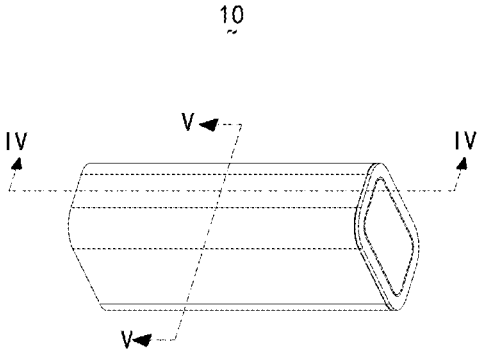
FIG. 1 is an isometric view of an electromagnetic speaker in accordance with a first exemplary embodiment of the present disclosure.
Figure 2:
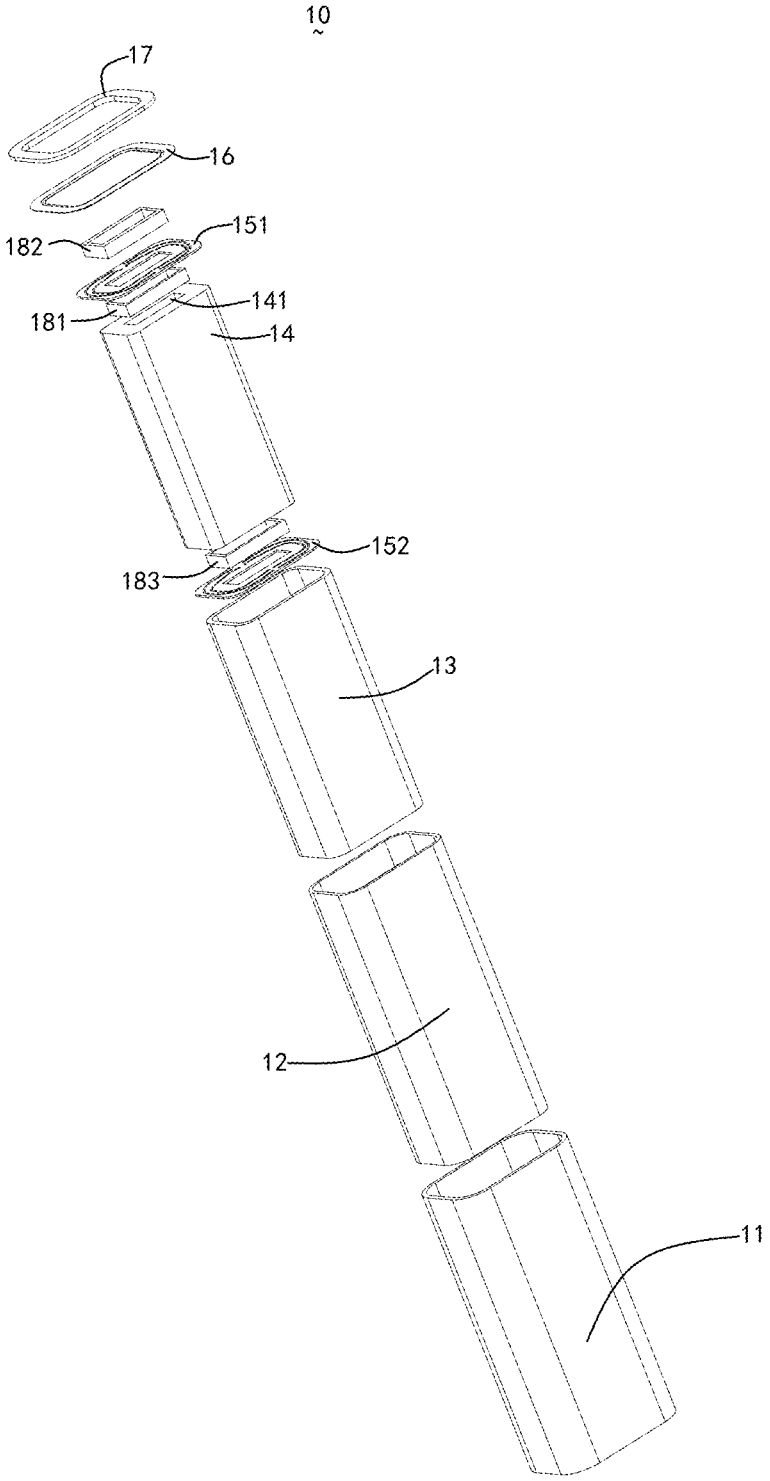
FIG. 2 is an exploded view of the electromagnetic speaker in FIG. 1.
Figure 5:
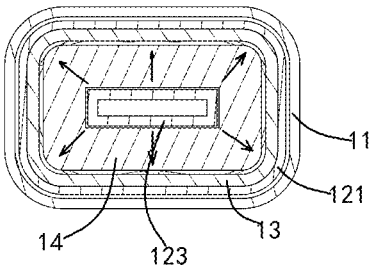
FIG. 5 is a cross-sectional view of the electromagnetic speaker in FIG. 1 taken along an radial direction, i.e., taken along line V-V.

Referring to FIGS. 1-2, an electromagnetic speaker 10 in accordance with a first exemplary embodiment of the present disclosure includes a hollow housing 11, a frame 12 encased by the housing 11, a voice coil 13 positioned by the frame 12, a magnet 14 received in the frame 12, a vibrating plate 16 connected with the magnet 14, and a front cover 17 for positioning the vibrating plate 16. The voice coil 13 is a hollow ring, and the magnet 14 is pillar-shaped. An outer diameter of the magnet 14 is smaller than an inner diameter of the voice coil 13. Further, the magnet is magnetized along a radial direction. In a cross-section taken along a direction perpendicular to a long axis of the pillar-shaped magnet 14, magnetic lines start from a center to an outside surface, or from the outside surface to the center, as shown in FIG. 5. The arrows in FIG. 5 indicate the magnetization direction of the magnet 14. The magnet 14 could a permanent magnet, and could also be a combination of a permanent magnet integrated with a magnetic conduction material.

The electromagnetic speaker 10 further includes a first elastic plate 151, a first connecting member 181 connecting the magnet 14 to one side of the first elastic plate 151, and a second connecting member 182 for connecting the vibrating plate 16 to the other side of the first elastic plate 151. In addition, the electromagnetic speaker 10 comprises a second elastic plate 152 for connecting to another end of the magnet 14, which is opposed to the end connected to the first elastic plate 151, via a third connecting member 183.

Figure 3:
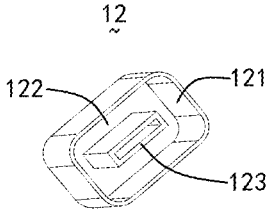
FIG. 3 is an isometric view of a frame of the electromagnetic speaker in FIG. 1.

Referring to FIG. 3, the frame 12 is hollow, and includes a sidewall 121 forming the hollow, a bottom wall 122 connecting the sidewall 121, and a supporting portion 123 extending perpendicularly from the bottom wall 122. The supporting portion 123 is located at a center of the bottom wall 122 and keeps a distance from the sidewall 121.

Figure 4:
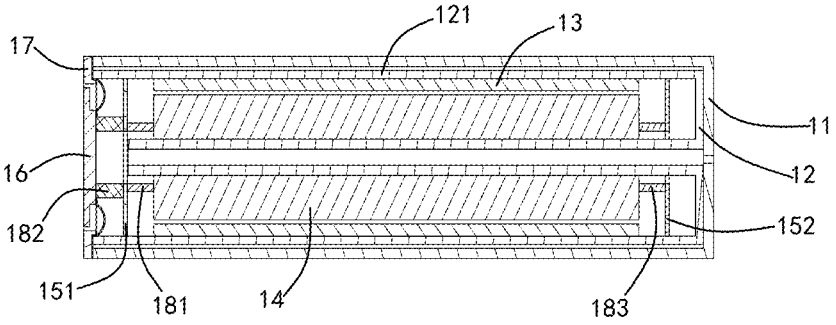
FIG. 4 is a cross-sectional view of the electromagnetic speaker in FIG. 1 taken along an axial direction, i.e., taken along line IV-IV.

Referring to FIGS. 4-5, FIG. 4 is a cross-sectional view of the electromagnetic speaker taken along line IV-IV, i.e., an axial direction of the speaker, and FIG. 5 is a cross-sectional view taken along line V-V, i.e., a radial direction of the speaker. The frame 12 is positioned inside of the housing 11, the voice coil 13 locates on the sidewall 121 of the frame 12, and the magnet 14 is disposed inside of the frame 12. The first and second elastic plates 151, 152 are arranged at two opposed sides of the magnet 14 and fixed to the frame 12 respectively. By virtue of the first and third connecting members 181, 183, the magnet 14 is connected to the first elastic plate 151 and the second elastic plate 152, respectively, thereby being suspended in the frame 12. Because the outer diameter of the magnet 14 is smaller than the inner diameter of the voice coil 13, the magnet 14 is indeed received in the voice coil 13. Referring back to FIG. 2, the magnet 14 further forms a through hole 141 for receiving the supporting portion 123 therein for forming a guiding member enabling the magnet 14 moving in the frame 12. Another word, the magnet 14 is moveable along the supporting portion 123. The engagement between the through hole 141 and the supporting portion 123 is used to ensure the moving direction of the magnet 14, and is an optimized configuration. Without the engagement of the through hole 141 and the supporting portion 123, the magnet 14 is also moveable by being suspended and supported by the first and second elastic plates 151, 152. Moreover, for avoiding the noises produced by the movement of the magnet 14, an inner diameter of the through hole 141 could be designed to be smaller than an outer diameter of the supporting portion 123.

In this embodiment, the first and second elastic plates 151, 152 are arranged at two sides of the magnet 14. Alternatively, more elastic plates could be used according to the length of the magnet 14. Or, only one elastic plate could be used. The usage of the elastic plates is to suspend the magnet 14 in the frame 12.

The first, second, third connecting members 181, 182, 183 may be adhesive layers, soldering pads, poles, or gaskets, as long as they can connect two adjacent components together. In this embodiment, the magnet 14 is connected to the vibrating plate 16 by the first elastic plate 151. Alternatively, the magnet 14 could also be directly connected to the vibrating plate 16. The front cover 17 presses on a periphery of the vibrating plate 16 for positioning the vibrating plate 16 to the frame or to the housing. Kindly be noted that the frame 12 and the housing 11 could exist together, or only the frame exists, or only the housing exists. The housing 11 and the frame 12 are used to assemble other components firmly and stably. Without the frame 12, the structures originally formed on the frame 12 could be directly formed on the housing 11. For example, the sidewall, the bottom wall, the supporting portion could be directly formed on the housing. In this case, the housing is indeed the frame. Without the housing, the embodiment is still workable.

Referring to FIG. 5, the magnet 14 is magnetized along the radial direction. As shown by the arrows, the magnetic field lines inside of the magnet 14 are from the center to the outer surface. As the voice coil 13 surrounds the magnet 14, the magnetic field lines pass through the voice coil 13 perpendicularly. When the voice coil 13 is electrified, Lorenz Force will be accordingly produced. Because the voice coil 13 is fixed by the frame 12, the voice coil 13 cannot move. By the reaction, the magnet 14 will be actuated to move. The movement of the magnet 14 is transferred to the vibrating plate 16 via the first elastic plate 151. Vibration of the vibrating plate 16 produces and radiates sounds. In this embodiment, the voice coil 13 and the magnet 14 are both located inside of the frame 12. In fact, the voice coil 13 may also locate outside of the frame 12, i.e., the sidewall 121 locates between the voice coil 13 and the magnet 14. The frame 12 may be made from magnetic conduction material.

By virtue of the configuration mentioned above, the electromagnetic speaker has a small form with a reduced height. Further, greater driving force is generated by the magnet driving the vibrating plate. When the electromagnetic speaker is mounted in a mobile phone, the vibrating plate vibrates along a direction parallel to the screen, and the amplitude thereof will not be affected by the height of the mobile phone. In fact, the amplitude of the vibrating plate at low frequency is greater than a normal speaker.

Figure 6:
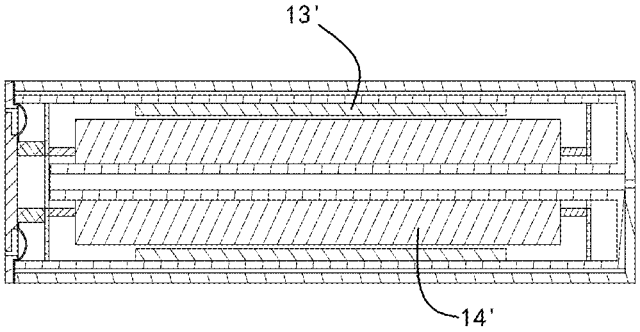
FIG. 6 is a cross-sectional view of an electromagnetic speaker in accordance with a second exemplary embodiment, taken along a radial direction thereof.

Referring to FIG. 6, a second exemplary embodiment is shown. What is different from the first embodiment is that a length of the voice coil 13' is smaller than that of the magnet 14', which enables the voice coil 13' to be covered completely by the magnetic field of the magnet 14'. Thus, the current through the voice coil 13' is used entirely and the driving force is accordingly improved.

Figure 7:
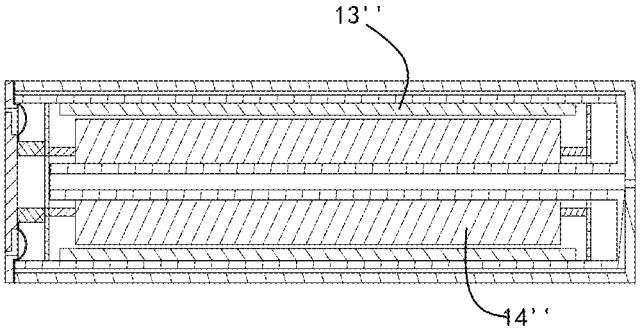
FIG. 7 is a cross-sectional view of an electromagnetic speaker in accordance with a third exemplary embodiment, taken along a radial direction thereof.

Referring to FIG. 7, a third exemplary embodiment is shown. What is different from the first embodiment is that a length of the voice coil 13" is greater than that of the magnet 14", which enables the magnet 14" to be covered completely by the voice coil 13". Thus, the magnetic field of the magnet 14" is used entirely and the driving force is accordingly improved.

Figure 8:
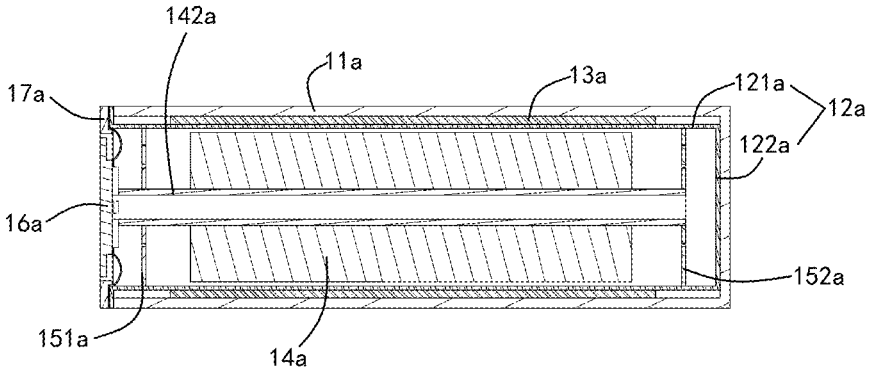
FIG. 8 is a cross-sectional view of an electromagnetic speaker in accordance with a fourth exemplary embodiment, taken along a radial direction thereof.

Referring to FIG. 8, an electromagnetic speaker in accordance with a fourth exemplary embodiment of the present disclosure includes a hollow housing 11*a*, a frame 12*a* encased by the housing 11*a*, a voice coil 13*a* positioned by the frame 12*a*, a magnet 14*a* received in the frame 12*a*, a vibrating plate 16*a* connected with the magnet 14*a*, and a front cover 17*a* for positioning the vibrating plate 16*a*. The voice coil 13*a* is a hollow ring, and the magnet 14*a* is pillar-shaped. The magnet 14*a* further includes a transmission pole 142*a* extending from two ends of the magnet 14*a*. One end of the transmission pole 142*a* connects to a first elastic plate 151*a* fixed to the frame 12*a*, and another end connects to a second elastic plate 152*a* fixed to the frame 12*a*. Thus, a combination of the magnet 14*a* and the transmission pole 142*a* is suspended in the frame 12*a* by the first and second elastic plates 151*a*, 152*a*. The frame 12*a* includes a bottom wall 122*a* and a sidewall 121*a* extending perpendicularly from the bottom wall 122*a*, and the magnet 14*a*, the transmission pole 142*a* are suspended in a space formed by the sidewall 121*a*. The voice coil 13*a* attaches to an outside of the sidewall 121*a*, i.e., the sidewall 121*a* locates between the voice coil 13*a* and the magnet 14*a*. The transmission pole 142*a* may be a part of the magnet 14*a*, or an individual component passing through the magnet 14*a*. The transmission pole 142*a* may be made from magnetic conduction material.

In this embodiment, the transmission pole 142*a* connects to the vibrating plate 16*a* and transmits the movement of the magnet 14*a* to the vibrating plate 16*a*. Alternatively, the first and second elastic plates 151*a*, 152*a* connect to the magnet 14*a* directly. Of course, the voice coil 13*a* can also attach to the inside of the sidewall 121*a*.

Figure 9:
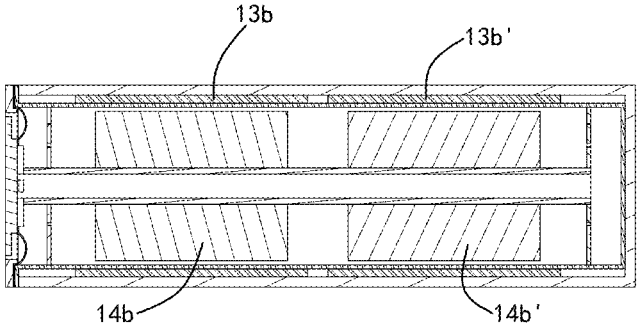
FIG. 9 is a cross-sectional view of an electromagnetic speaker in accordance with a fifth exemplary embodiment, taken along a radial direction thereof.

Referring FIG. 9, a fifth embodiment of the present disclosure is shown. What is different from the fourth embodiment is that two voice coils and two magnets are provided. The voice coils comprises a first coil 13*b* and a second coil 13*b*', and the magnets comprises a first magnet 14*b* and a second magnet 14*b*'. The first magnet 14*b* is surrounded by the first coil 13*b*, and the second magnet 14*b*' is surrounded by the second coil 13*b*'. By virtue of the cooperation between the two coils and the two magnets, driving force to the vibrating plate is improved.

The vibrating plate could be made from metal, plastic, glass, ceramic, or a compound of two or more materials. For obtaining better vibration performance, the vibrating plate could be made from a material having a small density and a greater stiffness.

The word "connect" or "connection" in the present disclosure means connecting one component to another component directly, or via a medium.

It is to be understood, however, that even though numerous characteristics and advantages of the present embodiments have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electromagnetic speaker, comprising:

a hollow housing;

a frame encased by the housing and having an elongated axis;

a magnet magnetized along a radial direction and received in the frame;

a voice coil fixed relatively to the frame and surrounding the magnet;

a first elastic plate suspending the magnet in the frame;

a vibrating plate driven by the magnet to move along the elongated axis of the frame for producing and radiating sounds;

a second elastic plate opposite to the first elastic plate and connecting to the magnet, and the magnet locating between the first elastic plate and the second elastic plate;

the frame comprising a bottom wall, and a sidewall extending perpendicularly from the bottom wall, wherein, the second elastic plate is located apart from the bottom wall without contacting the bottom wall, and the second elastic plate has a periphery fixed to the sidewall;

the sidewall is positioned apart from the housing, and at least a part of the bottom wall contacts and is fixed to the housing; and the voice coil is sandwiched between the sidewall and the housing.

2. The electromagnetic speaker as described in claim 1, wherein the first elastic plate locates between the magnet and the vibrating plate, and the magnet further includes a transmission pole via which the magnet connects to the vibrating plate, one end of the transmission pole connecting to the first elastic plate and the other end of the transmission pole connecting to the second elastic plate, the magnet as well as the transmission pole suspended in the frame by the first elastic plate and the second elastic plate together.

3. The electromagnetic speaker as described in claim 2, wherein the magnet locates between the first elastic plate and the second elastic plate, and the magnet connects to the second elastic plate via the transmission pole, the transmission pole penetrating the second elastic plate and extending into the magnet.

4. The electromagnetic speaker as described in claim 3, wherein the first elastic plate is an annual plate, and the transmission pole extends to the vibrating plate by running through the magnet and fixing to the first elastic plate.

5. The electromagnetic speaker as described in claim 4, wherein the transmission pole is assembled with two magnets, correspondingly, two voice coils are positioned on the frame.

6. The electromagnetic speaker as described in claim 4, wherein the first elastic plate is fixed to the sidewall of the frame.

7. The electromagnetic speaker as described in claim 4, wherein the second elastic plate is fixed to the sidewall of the frame.

8. The electromagnetic speaker as described in claim 1, wherein the second elastic plate is an annular plate.

9. The electromagnetic speaker as described in claim 8, wherein the frame includes a supporting portion extending from the bottom wall.

10. The electromagnetic speaker as described in claim 9, wherein the magnet further includes a through hole for receiving the supporting portion.

11. The electromagnetic speaker as described in claim 10, wherein the supporting portion runs through the second elastic plate and extends into the through hole.

12. The electromagnetic speaker as described in claim 1, wherein the first elastic plate locates between the magnet and the vibrating plate, and the magnet connects to the vibrating plate via the first elastic plate.

13. The electromagnetic speaker as described in claim 12 further including a first connecting member connecting the magnet to the first elastic plate.

14. The electromagnetic speaker as described in claim 13 further including a second connecting member connecting the vibrating plate to the first elastic plate, the first connecting member and the second connecting member locating at two sides of the first elastic plate respectively.

15. The electromagnetic speaker as described in claim 1, wherein the magnet connects to the second elastic plate via a third connecting member.

16. The electromagnetic speaker as described in claim 1, wherein a length of the voice coil is greater than a length of the magnet.

17. The electromagnetic speaker as described in claim 1, wherein a length of the voice coil is smaller than a length of the magnet.

* * * * *